United States Patent [19]

Mort

[11] Patent Number: 4,698,288

[45] Date of Patent: Oct. 6, 1987

[54] ELECTROPHOTOGRAPHIC IMAGING MEMBERS HAVING A GROUND PLANE OF HYDROGENATED AMORPHOUS SILICON

[75] Inventor: Joseph Mort, Webster, N.Y.

[73] Assignee: Xerox Corporation, Stamford, Conn.

[21] Appl. No.: 810,639

[22] Filed: Dec. 19, 1985

[51] Int. Cl.[4] ..... G03G 5/10

[52] U.S. Cl. ..... 430/58; 430/62; 430/63; 430/69

[58] Field of Search ..... 430/69, 57, 60, 74, 430/85, 58, 62, 63; 252/501.1

[56] References Cited

U.S. PATENT DOCUMENTS 4,365,015 12/1982 Kitajima et al. ..... 430/62
4,451,546 5/1984 Kawamura et al. ..... 430/69
4,462,862 7/1984 Kazama et al. ..... 156/643
4,464,451 8/1984 Shirai et al. ..... 430/65
4,491,626 1/1985 Kawamura et al. ..... 430/69
4,592,981 6/1986 Saitoh et al. ..... 430/69

FOREIGN PATENT DOCUMENTS 59-137916 10/1984 Japan .

*Primary Examiner*—John L. Goodrow
*Attorney, Agent, or Firm*—E. O. Palazzo

[57] ABSTRACT

Disclosed is a photoresponsive imaging member comprised of a supporting substrate, a ground plane of hydrogenated amorphous silicon having incorporated therein dopants; and a photoconductive layer comprised of hydrogenated amorphous silicon.

46 Claims, 4 Drawing Figures

ELECTROPHOTOGRAPHIC IMAGING MEMBERS HAVING A GROUND PLANE OF HYDROGENATED AMORPHOUS SILICON

BACKGROUND OF THE INVENTION

The invention of the present application is generally directed to electrophotographic imaging members, and more specifically, the present invention relates to photoconductive imaging members comprised of amorphous tetrahedral materials and an easily fabricated ground plane layer. One embodiment of the present invention envisions a layered photoresponsive flexible imaging member comprised of amorphous silicon and a ground plane comprised of hydrogenated amorphous silicon suitably doped with p and/or n components. Accordingly, thus the ground plane layer selected for the invention of the present application can be comprised of hydrogenated amorphous silicon containing therein in effective amounts dopants such as phosphorus and/or boron. The aforementioned ground plane layers can be economically fabricated, and possess desirable adhesion and stability characteristics, particularly as compared to presently known ground planes which include polymer substrates that have been subjected to pre-metallization. Also, the imaging members of the present invention can be incorporated into electrophotographic, and particularly xerographic imaging processes wherein the latent electrostatic images formed can be developed into images of high quality with excellent resolution. Moreover, the imaging members of the present invention may be economically fabricated without concerns relating to the damaging of fragile deposited metal ground planes of the prior art; possess improved adhesion and reduction of stress, important properties in achieving flexibility; are of sufficient transparency for rear illumination; and further can be selected for positively charged or negatively charged imaging modes. Furthermore, the imaging members of the present invention can be selected for xerographic printing proceses; and are also useful wherein the images formulated are rendered visible with liquid developer compositions.

Electrostatographic imaging systems, and particularly xerographic imaging processes are extensively described in the prior art. Generally, in these processes, a photoresponsive or photoconductive material is selected for forming the latent electrostatic image thereon. The photoreceptor can be comprised of a conductive substrate containing on its surface a layer of photoconductive material, and in many instances a thin barrier layer is situated therebetween to preent charge injection from the substrate, which could adversely affect the quality of the resulting image. Examples of known useful photoconductive materials include amorphous selenium, alloys of selenium such as selenium tellurium, selenium arsenic, and the like. Additionally, there can be selected as the imaging member various organic photoconductive materials including, for example, complexes of trinitrofluorenone and polyvinylcarbazole. Recently, there has been disclosed layered organic photoresonsive devices with arylamine hole transport molecules and photogenerating layers, reference for example U.S. Pat. No. 4,265,990, the disclosure of which is totally incorporated herein by reference.

Also known are amorphous silicon phoroconductors, reference for example U.S. Pat. Nos. 4,265,991 and 4,225,222. There is disclosed in the U.S. Pat. No. 4,265,991 an electrophotographic photosensitive member comprised of a substrate, and a photoconductive overlayer of amorphous silicon containing 10 to 40 atomic percent of hydrogen and having a thickness of 5 to 80 microns. Additionally, this patent describes several processes for preparing amosphous silicon. In one process, there is prepared, in accordance with the teachings of the U.S. Pat. No. 4,265,991, an electrophotographic photosensitive member which involves heating a member present in a chamber to a temperature of 50° C. to 350° C., introducing a gas with a hydrogen atom, providing an electrical discharge in the chamber by electric energy to ionize the gas, followed by depositing amorphous silicon on an electrophotographic substrate at a rate of 0.5 to 100 Angstroms per second by utilizing an electric discharge while raising the temperature of the substrate thereby resulting in an amorphous silicon photoconductive layer of a predetermined thickness. Although the amorphous silicon device described in this patent is photosensitive, after a minimum number of imaging cycles, less than about 100 for example, unacceptable low quality images of poor resolution with many deletions may result. With further cycling, that is subsequent to 100 imaging cycles the image quality may continue to deteriorate often until images are partially deleted.

There are also illustrated in copending applications photoconductive imaging members comprised of amorphous silicon. Accordingly, for example, there is disclosed in copending application U.S. Ser. No. 695,990, entitled Electrophotographic Devices Containing Compensated Amorphous Silicon Compositions, the disclosure of which is totally incorporated herein by reference, an imaging member comprised of a supporting substrate and an amorphous hydrogenated silicon composition containing from about 25 parts per million by weight to about 1 percent by weight of boron compensated with substantially equal amounts of phosphorus and boron. Furthermore, described in copending application U.S. Ser. No. 548,117, entitled Electrophotographic Devices Containing Overcoated Amorphous Silicon Compositions, the disclosure of which is totally incorporated herein by reference, are imaging members comprised of a supporting substrate, an amorphous silicon layer, a trapping layer comprised of doped amorphous silicon, and a top overcoating layer. Additionally, described in copending application U.S. Ser. No. 662,328, entitled Heterogeneous Electrophotographic Imaging Members of Amorphous Silicon, the disclosure of which is totally incorporated herein by reference, are imaging members comprised of hydrogenated amorphous silicon photogenerating compositions, and a charge transporting layer of plasma deposited silicon oxide. There is further disclosed in the latter copending application an interface transition gradient between the silicon oxide charge transport layer and the photogenerating layer.

Representative prior art patents that disclose amorphous silicon imaging members include, for example, U.S. Pat. No. 4,357,179 directed to methods for preparing imaging members containing high density amorphous silicon or germanium; U.S. Pat. No. 4,237,501 which discloses a method for preparing hydrogenated amorphous silicon wherein ammonia is introduced into a reaction chamber; U.S. Pat. Nos. 3,160,51; 3,160,522; 3,496,037; 3,892,650; 4,237,151; 4,356,246; 4,359,512; 4,359,514; 4,361,638, 4,365,013; 4,365,015, see column 5;

4,377,628; 4,394,415; 4,394,426; 4,397,933; 4,403,026; 4,404,076; 4,409,308; 4,414,319; 4,416,962; 4,420,546; 4,423,133; 4,443,529; 4,451,546; 4,452,872; 4,452,875; 4,460,669; 4,460,670; 4,461,819; 4461,820; 4,462,862; 4,464,451; 4,465,750; 4,471,042; 4,477,549; 4,483,911; 4,484,809; 4,486,512;4,490,453;4,490,454; and 4,491,626.

Ground planes selected for many of the modern photoconductive imaging members must be highly flexible and adhere well to supporting substrates, particularly belt type photoreceptors over many thousands of imaging cycles. One ground plane selected for the aforementioned photoreceptors is vacuum deposited aluminum. However, aluminum films suffer from the disadvantage that they are relatively soft and exhibit poor scratch resistance during the photoreceptor fabrication processing. Additionally, vacuum deposited aluminum exhibits poor optical transmission stability after extended cycling in xerographic imaging apparatuses. This poor optical transmission stability is believed to be the result of the oxidation of the aluminum ground plane as electric current is passed across the junction between the metal and the photoreceptor. Further, the optical transmission degradiation is continuous, and for systems utilizing the erase lamps, on the non-imaging side of the photoconductive belt or web, it is necessary to adjust the erase intensity every 20,000 copies.

Aluminum ground planes of the prior art have also been found to be unstable over extended image cycling with a multistructured photoreceptor. Thus, for example, the oxides of aluminum which form on the aluminum metal selected as an electrical blocking layer cna prevent charge injection during charging of the photoconductive device. When the resistivity of the blocking layer is high, the residual potential will build across the layer as the device is subjected to cycling. Also, as the thickness of the oxide layer on the aluminum ground plate is not stable, the electrical performance characteristics of a composite photoreceptor may undergo changes during electrophotographic cycling. Further, the storage life of many composite photoreceptors with aluminum ground planes can be less than one day at high temperatures and humidity greater than 50 percent, for example, because of the accelerated oxidation of the metal. Accelerated oxidation increases optical transmission, causes copy quality nonuniformity, and may ultimately result in a loss of electrical grounding capability.

Additionally, many metals or other materials, including free metal polymers, which are highly oxidatively stable, may form a low energy injection barrier to the photoconductive material when utilized as a ground plane in a photoconductive imaging member. A hole blocking layer will usually not form on these oxidatively stable layers thus rendering the devices substantially nonfunctional as photoconductive members. Further, with respect to flexible imaging members, particularly flexible amorphous tetrahedral photoreceptors, there are selected as substrates polymers which because of their insulating characteristics must be provided with a ground plane. Usually this is achieved by premetallization of the polymer substrate, thus there results increased costs and corners relating to adhesion and/or stability characteristics of the ground plane material. Photoresponsive imaging members of the present invention overcome these problems, and more specifically with the members of th epresent invention there is improved adhesion between the ground plane and the supporting substrate. Moreover, the optical properties of the ground plane selected for the members of the present invention provide sufficient transparency for rear illumination erasure; and additionally enable a reduction in the cost of the substrate selected.

Furthermore, thee is disclosed in a copending application U.S. Ser. No. 610,552, entitled Electrophotographic Imaging Member and Process, the disclosure of which is totally incorporated herein by reference, an electrophotographic imaging member comprising a substrate, a titanium metal layer contiguous to the substrate, a charge blocking layer, a charge generator binder layer, and a charge transport layer. Disadvantages associated with the titanium metal layer include, for example, high cost, poor scratch resistance during photoreceptor fabrication, and non-optimum compabitility with plasma deposited amorphous silicon with respect to adhesion and flexibility. Additionally, the aforementioned copending application is silent with respect to amorphous silicon imaging members. Prior art of interest with respect to the subject matter of the copending application includes U.S. Pat. Nos. 3,725,058; 4,439,507; 3,926,762; 3,895,944; 4,233,384; 3,484,237; 4,265,990; 4,306,008; 4,299,897, 4,439,507; 4,026,703; 4,291,110; 3,837,851; 4,286,033; 4,349,617; 4,150,987; 3,880,657; 4,123,267; 4,322,276; 4,370,360; 4,307,942; 4,358,478; 3,201,667; and U.K. No. 1,010,331.

Although the above described imaging members, particularly the amorphous silicon photoresponsive imaging members, may be useful for their intended purposes, there continues to be a need for new imaging members. Also, there is a need for improved photoconductive imaging members with sufficiently adhered ground planes which can be continuously used in a number of imaging cycles without deterioration therefrom. Further, there is a need for improved photoresponsive imaging members with ground planes of hydrogenated amorphous silicon containing dopants therein, and wherein the resulting member is humidity insensitive and not adversely affected by the electrical consequences resulting, for example, from scratching and abrasion. Moreover,there is a need for improved photoconductive imaging members with ground planes that can be prepared with a minimum number of processing steps, and wherein the layers are sufficiently adhered to one another to enable the continuous use thereof in repetitive imaging and printing processes. Furthermore, there is a need for a photoresponsive imaging members with ground planes that possess superior hardness characteristics enabling them to be useful for substantially an unlimited number of imaging cycles. Additionally, there is a need for flexible imaging members with ground planes that are sufficiently adhered to the supporting substrate. Furthermore, there is a need for amorphous silicon imaging members with ground planes that can be charged to either a positive or negative polarity.

SUMMARY OF THE INVENTION

It is, therefore, an object of the present invention to proivde photoresponsive imaging members which overcome many of the above-noted disadvantages.

In yet another object of the present invention there are provided photoconductive imaging members with easily fabricable ground planes.

In a further object of the present invention there are provided layered photoresponsive hydrogenated amorphous silicon imaging members and substantially permanently adhering ground plane layers incorporated therein.

Another object of the present invention resides in the provision of hydrogenated amorphous silicon photoconductive imaging members with ground planes comprised of hydrogenated amorphous silicon with dopants therein.

Also, in a further object of the present invention there are provided amorphous silicon photoconductive imaging members with grounds planes of hydrogenated amorphous silicon containing as dopants therein boron.

In still a further object of the present invention there are provided amorphous silicon photoconductive imaging members with ground planes of hydrogenated amorphous silicon containing as dopants therein phosphorus.

Another object of the present invention resides in the provision of imaging members wherein the ground plane can be prepared in an economical manner.

Also, there is provided in accordance with the present invention hydrogenated amorphous silicon imaging members with specific ground plane members contiguous to a supporting substrate and wherein the members further include thereover protective overcoating layers, such as those illustrated in copending application U.S. Ser. No. 548,117, the disclosure of which is totally incorporated herein by reference, inclusive of silicon nitride, silicon carbide, amorphous carbon, and silicon carbide.

Furthermore, in other objects of the present invention there are provided photoconductive imaging members containing therein specific ground planes as a component; and processes and apparatuses for affecting the preparation of the aforementioned members.

These and other objects of the present invention are accomplished by the provision of amorphous tetrahedral photoreceptors with specific ground planes. More specifically, in accordance with the present invention there are provided hydrogenated amorphous silicon photoresponsive imaging members having incorporated therein ground planes of hydrogenated amorphous silicon with dopants therein. In one specific embodiment of the present invention there is provided a hydrogenated amorphous silicon photoconductive imaging member comprised of a supporting substrate inclusive of insulating nonmetallic substrates and contiguous therewith a ground plane layer comprised of hydrogenated amorphous silicon having incorporated therein p dopants, n dopants, or mixtures thereof; and a photoconductive layer of hydrogenated amorphous silicon. Therefore, in accordance with one embodiment of the present invention, the ground plane selected can be comprised of hydrogenated, about 10 to 40 atomic percent of hydrogen, amorphous silicon and from about 1 part per million to about 10,000 parts per million of phosphorus, or from about 1 part per million to about 10,000 parts per million of boron.

Another specific photoconductive imaging member of the present invention is comprised of a supporting substrate, contiguous thereto a ground plane selected from the group consisting of hydrogenated amorphous silicon having incorporated therein phosphorus, preferably in an amount of 10,000 parts per million, and hydrogenated amorphous silicon having incorporated therein boron, preferably in an amount of about 10,000 parts per million; and a photoconductive layer of hydrogenated amorphous silicon. Alternatively, the imaging members of the present invention can be comprised of a supporting substrate, in contact therewith a ground plane comprised of hydrogenated amorphous silicon containing therein dopants selected from the group consisting of boron and phosphorus, or mixtures thereof; a photoconductive layer of hydrogenated amorphous silicon with from about 5 to about 70 atomic percent of hydrogen; and thereover an optional overcoating selected from the group consisting of silicon nitrides, silicon carbides, and amorphous carbon.

Other photoconductive member configurations included within the scope of the present invention are illustrated in copending application U.S. Ser. No. 695,990 entitled Electrophotographic Devices Containing Compensated Amorphous Silicon Compositions; copending application U.S. Ser. No. 548,117 entitled Electrophotographic Devices Containing Overcoated Amorphous Silicon Compositions; and copending application U.S. Ser. No. 662,328 entitled Heterogeneous Electrophotographic Imaging Members of Amorphous Silicon. The disclosures of all of these copending applications are totally incorporated herein by reference. With further reference to the aforementioned copending application photoconductive imaging members, they must include therein in addition to the components recited the ground plane layer of the present invention.

The photoresponsive or photoconductive members of the present invention can be incorporated into various imaging apparatuses wherein, for example, latent electrostatic images are formed followed by development, subsequently transferring the developed image to a suitable substrate; and optionally permanently affixing the image thereto by heat, for example. These photoresponsive imaging members possess the desirable properties indicated herein, including excellent adhesion of the ground plane layer, enabling their use for an extended number, 100,000 for example, of imaging cycles. Moreover, the photoconductive imaging members of the present invention in certain configurations can be selected for use in xerographic printing processes, that is for example, wherein the member includes therein a component which is sensitive to the infrared region of the spectrum. Additionally, the photoresponsive imaging members of the present invention can be incorporated into imaging apparatuses, wherein there is selected for rendering the images visible a liquid development process.

BREIF DESCRIPTION OF THE DRAWINGS

For a better understanding of the present invention and further features thereof, reference is made to the following detailed description of various preferred embodiments wherein.

DESCRIPTION OF THE PREFERRED EMBODIMENTS

Figure 1:
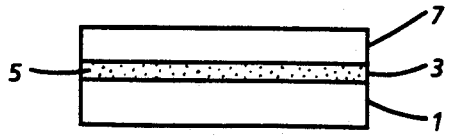
FIG. 1 is a partially schematic cross-sectional view of the photoresponsive imaging member of the present invention.

Illustrated in FIG. 1 is a photoresponsive imaging member of the present invention comprised of a supporting substrate 1, a ground plane layer 3 in a thickness, for example, of from about 0.05 to about 5 microns, and preferably 0.5 microns; and comprised of hydrogenated amorphous silicon having incorporated therein, in an effective amount, p or n dopants 5; and a hydrogenated amorphous silicon photoconducting layer 7, in a thickness of from about 5 to about 50 microns, and preferably containing therein from about 10 to about 50 atomic percent hdyrogen; and optional dopants of, for example, phosphorous or boron in amounts of up to 50 parts per million.

Figure 2:
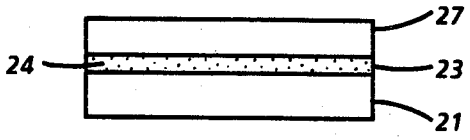
FIG. 2 is a partially schematic cross-sectional view of a further photoresponsive imaging member of the present invention.

Illustrated in FIG. 2 is a photoconductive member of the present invention comprised of an insulating nonmetallic polymeric supporting substrate 21; a ground plane 23, in a thickness of from about 0.05 microns to about 5 microns, and preferably 0.5 microns; and comprised of hydrogenated amorphous silicon with from about 10 to about 50 atomic percent hydrogen; and incorporated therein as a dopant phosphorous 24 preferably in an amount of 10,000 parts per million; and in contact therewith a photoconductive layer of hydrogenated amorphous silicon 27.

Figure 3:
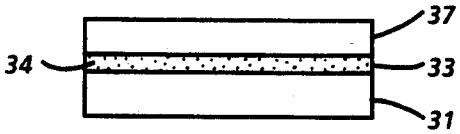
FIG. 3 illustrates another photoresponsive imaging member embodiment of the present invention.

Illustrated in FIG. 3 is a photoconductive member of the present invention comprised of an insulating nonmetallic polyermic supporting substrate 31; a ground plane 33, in a thickness of from about 0.05 microns to about 5 microns, and preferably about 0.5 microns; and comprised of hydrogenated amorphous silicon with from about 10 to about 50 atomic percent hydrogen; and incorporated therein as a dopant boron 34 preferably in an amount of 10,000 parts per million; and in contact therewith a photoconductive layer of hydrogenated amorphous silicon 37.

Figure 4:
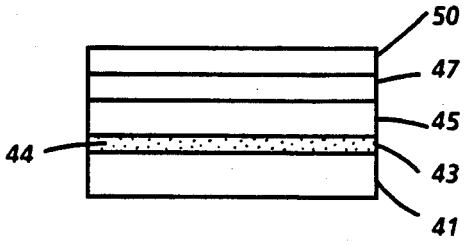
FIG. 4 illustrates yet another photoresponsive imaging member embodiment of the present invention.

Illustrated in FIG. 4 is a further imaging member of the present invention including therein a charge transport layer of silicon oxides. More specifically, there is illustrated in FIG. 4 a photoresponsive imaging member comprised of a supporting substrate 41; a ground plane layer 43 comprised of hydrogenated amorphous silicon having incorporated therein dopants 44 inclusive of phosphorus or boron; a transport layer of plasma deposited silicon oxide 45, in a thickness of from about 1 to about 10 microns; a photoconductive layer 47 of hydrogenated amorphous silicon with from about 10 to about 50 atomic percent hydrogen, preferably of a thickness of from about 0.5 to about 2 microns; and thereover an optional transparent partially conductive top overcoating layer 50 of a thickness of from about 0.1 to about 0.5 micron. Photoresponsive imaging members similar to the latter devices are illustrated in copending application U.S. Ser. No. 662,328, the disclosure of which was previously incorporated herein by reference. In the imaging members of the present invention, as contrasted to those of the copending application, there is incorporated therein the ground plane layer.

Moreover, the photoresponsive imaging members illustrated in FIGS. 1 to 3 herein can include protective top overcoatings thereover of, for example, silicon nitrides, silicon carbides, and amorphous carbon, reference for example copending application U.S. Ser. No. 548,117, the disclosure of which was previously incorporated herein by reference.

More specifically, there can be included overcoatings comprised of, for example, silicon nitride or silicon carbide, which may be rendered conductive by fabricating these layers in a manner that a nonstoichiometric composition $SiN_x$ $SiC_y$ results, wherein x is a number of from about 1 to about 1.3, and y is a number of from 0.7 to about 1.3, reference copending application Ser. No. 548,117, the disclosure of which is totally incorporated herein by reference. Moreover, there is included as overcoatings for the photoresponsive imaging members silicon carbide or amorphous carbon doped with about 0.5 percent to about 5 percent of phosphorus or boron, which doping renders the overcoatings partially conductive enabling a further enhancement in image quality.

The supporting substrates for each of the photoresponsive devices illustrated in the Figures may be opaque or substantially transparent. Thus, the substrate can be comprised of numerous substances providing the objectives of the present invention are achieved. Specific examples of substrates include insulating materials such as inorganic or organic polymeric compositions; inclusive of polyimides, such as Kapton commercially available; polycarbonates; and other similar components. Also, as substrates there can be selected, for example, aluminum, chromium, nickel, brass, stainless steel, ceramics, and the like. The substrate may be flexible or rigid, and can have many different configurations, inclusive of, for example, a plate, a cylindrical drum, a scroll, an endless flexible belt, and the like. Preferably, the substrate is in the form of a cylindrical drum or endless flexible belt. In some situations, it may be desirable to coat on the back of the substate, particularly when the substrate is an organic polymeric material, an anticurl layer such as, for example, polycarbonate materials commercially available as Makrolon.

Further, the thickness of the substrate layer depends on many factors including economical considerations, and the mechanical properties desired. Accordingly, for example, thus this layer can be of a thickness of from about 0.01 inch (254 microns) to about 0.2 inch (5080 microns); and preferably is of a thickness of from about 0.05 inch (1270 microns) to about 0.15 inch (3810 microns). In one embodiment, the supporting substrate is comprised of oxidized nickel in a thickness of from about 1 mil to about 10 mils.

The photoresponsive devices of the present invention can be prepared by simultaneously introducing into a reaction chamber, such as that illustrated in U.S. Pat. No. 4,513,022, the disclosure of which is totally incorporated herein by reference, a silane gas, a source of phosphorus, such as phosphine; and/or a source of boron, such as diborane gas. More specifically, this process involves providing a receptacle containing therein a first substrate electrode means, and a second counterelectrode means providing cylindrical surface on the first electrode means; heating the cylindrical surface with heating elements contained in the first electrode means while causing the first electrode means to axially rotate; introducing simultaneously into the reaction vessel a source of silicon containing gas, such as a silane gas, a phosphorous containing gas, such as phosphine, and a boron containing gas such as diborance at a right angle with respect to the cylindrical member; applying a voltage between the first and second electrode means providing a current to the second electrode means whereby the silane gas is decomposed resulting in the deposition of a ground plane of amorphous silicon containing phosphorus and boron therein, on the cylindrical surface. The dopant gases are introduced into the reaction chamber in appropriate relative amounts to provide the level of compensation as indicated herein. Thus, or example, when a nominal level of doping is desired, that is amorphous silicon containing 100 parts per million of boron, and 100 parts per million of phosphorus, there is simultaneously introduced into the receptable silane gas containing about 90 parts per million of phosphine and about 100 parts per million of diborane gas. Also, when a dopant level of 10,000 parts per million is desired, there is introduced into the reaction receptacle silane gas, with 1 percent phosphine, and 1 percent of diborane gas. Thereafter, the hydrogenated amorphous silicon photoconductive layer is deposited by the decomposition of a silane gas as illustrated in the U.S. Pat. No. 4,513,022. More specifically, the process and apparatus useful for preparing the photoresponsive devices of the present invention is disclosed in the Figures of the U.S. Pat. No. 4,513,022, wherein, for example, a rotating cylindrical first electrode means is secured on an electrically insulating rotating shaft with radiant heating elements situated within the first electrode means, connecting wires, a hollow shaft rotatable vacuum feedthrough, a heating source, a hollow drum substrate containing therein the first electrode means, the drum substrate being secured by end flanges, which are part of the first electrode means, a second hollow counterelectrode means containing flanges thereon and slits or vertical slots, a receptacle or chamber means containing as an integral part thereof receptacles for the flanges for mounting the module in the chamber, a capacitive manometric vacuum sensor, a gauge, a vacuum pump, with a throttle valve, mass flow controls, a gauge and set point box, gas pressure vessels, for example, and presure vessel containing silane gas, another pressure vessel containing phosphine gas, and a third containing diborance gas, a current source means for the first electrode means, and a second counterelectrode means. The chamber contains an entrance means for the source gas material and an exhaust means for the unused gas source material. Generally, in operation the chamber is evacuated by vacuum pump to an appropriate low pressure. Subsequently, a silane gas, a phosphine gas and a diborance gas are simultaneously introduced into the chamber through the entrance means, the flow of the gases being controlled by the mass flow controller. These gases are introduced into the entrance in a crossflow direction, that is, the gas flows in the direction perpendicular to the axis of the cylindrical substrate contained on the first electrode means. Prior to the introduction of the gases, the first electrode means is caused to rotate by a motor and power is supplied to the radiant heating elements by heating source, while voltage is applied to the first electrode means and the second counterelectrode means by a power source. Generally, sufficient power is applied from the heating source that will maintain the drum at a temperature ranging from about 100° C. to about 300° C., and preferably at a temperature of about 200° C. to 250° C. The pressure in the chamber is automatically regulated so as to correspond to the settings specified at the gauge by the position of a throttle valve. An electrical field created between the first electrode means the second counterelectrode means causes the silane gas to be decomposed by glow discharge whereby a ground plane amorphous silicon containing phosphorus and boron are deposited in a uniform thickness of the surface of the cylindrical means contained on the first electrode means. Thereafter, the photoconductive layer is applied in a similar manner.

Photoresponsive devices containing overcoatings of silicon nitride, or silicon carbide are generally prepared by the glow discharge deposition of mixtures of silane and ammonia, or silane and nitrogen; and silane with a hydrocarbon gas, such as methane, using the apparatus of the U.S. Pat. No. 4,513,022, for example, which overcoatings are deposited on the photoconductive amorphous silicon layer. Amorphous carbon is deposited as an overcoating in a similar manner with the exception that there is selected for the flow discharge apparatus a hydrocarbon gas such as methane.

With further respect to the present invention, the purpose of the ground plane layer is to provide the necessary electrical contact between the ground of the power supply that drives the charging corotron, and an electrical path to ground for the charge motion produced by the subsequent photodischarge. The ground plane layer is comprised of substantially hydrogenated amorphous silicon with dopants present in an amount of from about 1 part per million to about 10,000 parts per million. Dopants that are selected include those from elements of Groups III and V of the periodic table, such as phosphorus, boron, arsenic, nitrogen, and the like. Preferred dopants are phosphours and boron. This layer can be applied to the supporting substrate by introducing the appropriate gases into the reaction chamber described herein in effective amounts in accordance with the teachings, for example, as illustrated in U.S. Pat. No. 4,513,022, as detailed herein, the disclosure of which has been previously incorporated herein by reference.

The invention will now be described in detail with respect to specific preferred embodiments thereof, it being understood that these examples are intended to be illustrative only. The invention is not intended to be limited to the materials, conditions or process parameters recited herein. All parts and percentages are by weight unless otehrwise indicated.

EXAMPLE I

An amorphous silicon photoreceptor was fabricated on a 9.5 inch diameter cylindrical aluminum drum of 16.75 inches length by first heating the drum substrate to 200° C. in a vacuum system which was substantially similar in contruction to that described in U.S. Pat. No. 4,513,022, the disclosure of which is totally incorporated herein by reference, or U.S. Pat. No. 4,466,380, reference for example FIG. 3, the disclosure of which is totally incorporated herein by reference. Monosilane gas and diborane gas at flow rates of 200 sccm and 2 sccm, respectively, were subsequently admitted to the vacuum system. Also, the system pressure for the gas mixture was determined by a throttle valve in the vacuum exhaust line and held constant at 250 mTorr. Thereafter, glow discharge was initiated at this pressure and maintained for 10 minutes, and there was selected a radio frequency power supply with a frequency of 13.56 MHz at a net power level of 100 watts. The drum substrate, electrically connected to the power supply by slip rings, was rotated during the deposition at a rotational speed of 5 rpm. The counterelectrode present was stationary and electrically grounded. Without breaking the vacuum, a hydrogenated amorphous silicon film photoconductive layer with 40 atomic percent of hydrogen was deposited subsequent to the deposition of the boron doped silicon ground plane by reducing the diborane gas stream to 0.002 sccm. The glow discharge of this new gas mixture was continued for 3 hours after which the electrical discharge to the drum was discontinued. There resulted an imaging member with the ground plane 1,000 Angstroms in thickness deposited on aluminum; and a top layer to hydrogenated amorphous silicon.

Subsequently, a mixture of 2:1 ammonia to silane gas was introduced into the reactor at a combined flow rate of 200 sccm and at a pressure of 250 millitorr. This mixture was plasma deposited for 6 minutes at a power of 100 watts after which the electrical discharge and heating to the drum were discontinued. Subsequently, the drum member was removed from the vacuum system and was found by microscopic inspection techniques to consist of, in addition to the aluminum substrate, a ground plane, 1,000 Angstroms in thickness of hydrogenated amorphous silicon heavily doped with 10,000 parts per million of boron; followed by 20 microns of slightly boron, 5 parts per million,, doped amorsphous silicon photoconductive layer; and 3000 Angstroms layer of a silicon nitride overcoating. This drum was incorporated in an electrographic imaging machine, available as the Xerox Corporation 3100®, which employed positive corona charging. Images of excellent resolution, no blurring, were obtained for up to 1,000 imaging cycles, at which time the test was discontinued.

EXAMPLE II

An amorphous silicon photoreceptor was fabricated as described in Example I except that the first deposited ground plane layer was produced by using a mixture of monosilane gas and phosphine gas at flow rates of 200 sccm and 0.1 sccm, respectively, with the discharge maintained for 10 minutes. The second photoconductive layer was produced by the flow discharge of monosilane gas alone at a flow of 200 sccm with a discharge maintained for 3 hours. Subsequently, the top layer of amorphous silicon nitride, was produced as described in Example 1. The drum member resulting consisted of, in addition to the substrate, a ground plane; 1,000 Angstroms of heavily, 10,000 parts per million of phosphorus doped hydrogenated, 40 atomic percent, amorphous silicon, followed by 20 microns of undoped hydrogenated, 40 atomic percent, amorphous silicon and a 3,000 Angstrom layer of a silicon nitride overcoating. This drum was incorporated in a xerographic imaging machine which employed negative corona charging. Images of excellent resolution, no blurring, were obtained for up to imaging 1,000 cycles, at which time the test was discontinued.

EXAMPLE III

A photoreceptor device was fabricated by repeating the procedure of Example I with the exception that the polymer Kapton in sheet form was clamped around the drum substrate for the primary purpose of insuring thermal contact with the aluminum drum. There resulted a substantially similar photoreceptor with a flexible polymeric substrate which was subsequently evaluated in a xerographic imaging apparatus as described in Example I with substantially similar results, that is, there was achieved images of excellent quality. Specifically, this device was subsequently evaluated in the xerographic imaging apparatus as described in Example I with substantially similar results, that is, there was achieved images of excellent quality, no background or image blurring, for up to 1,000 imaging cycles.

EXAMPLE IV

A photoreceptor device was fabricated by repeating the procedure of Example III, and thereafter the resulting photoreceptor with the flexible polymer substrate was evaluated in the xerographic imaging apparatus of Example I wherein negative corona charging was selected. Images of excellent quality, no blurring, were achieved for up to 1,000 imaging cycles at which time the test was discontinued.

EXAMPLE V

An amorphous silicon - silicon oxide photoreceptor was fabricated on 9.5 inch diameter cylindrical aluminum drums of 16.75 inches length by first heating to 200° C. the drum substrates in a vacuum system similar in construction to the apparatus disclosed in U.S. Pat. No. 4,466,380, reference for example FIG. 3. An electrical discharge was maintained for 15 minutes, and under these conditions monosilane gas and phosphine gas at flow rates of 200 sccm and 0.1 sccm were admitted at a pressure of 250 mTorr permitting formation of a hydrogenated, 40 atomic percent, amorphous silicon ground plane with 10,000 parts per million of phosphorus. Nitrous oxide gas and monosilane gas were subsequently introduced into the vacuum system to enable formation of the silicon oxide charge transport layer, reference U.S. Ser. No. 662,328, at flow rates of 200 standard cubic centrimeters per minute (sccm) and 20 sccm, respectively. The system pressure for this mixture was determined by a throttle valve in the vacuum exhaust line and held constant at 250 milliTorr. The glow discharge initiated at this pressure and maintained for three hours was excited by a radio frequency power supply with a frequency of 100 kHz at a net power level of 100 watts. The drum blank, electrically connected to the power supply by slip rings, was rotated during the deposition of the film at a rotational speed of 5 rpm. The counterelectrode was stationary and electrically grounded Without breaking the vacuum, an amorphous hydrogenated, 40 atomic percent hydrogen, silicon photoconductive layer was deposited subsequent to the deposition of the silicon oxide film by terminating the nitrous oxide gas stream and increasing the silane gas stream to 200 sccm. The silane discharge was continued for 20 minutes after which the electrical discharge to the drum was discontinued. Subsequently, a mixture of 2:1 ammonia to silane gas was introduced into the reactor at a combined flow rate of 200 sccm, and at a pressure of 250 milliTorr. This mixture was plasma deposited for 6 minutes at a power of 100 watts after which the electrical discharge, and heating to the drum were discontinued. The drum member was removed from the vacuum system and was found by microscopic inspection techniques to consists of, in addition to the aluminum substrate, 1,000 Angstroms of a ground plane of heavily phosphorus doped hydrogenated amorphous silicon; 10 microns of a silicon oxide charge transport layer, followed by a one-half micron layer of a hydrogenated 40 atomic percent of a hydrogen amorphous silicon photoconductive layer; and a 3,000 Angstrom layer of a silicon nitride overcoating. This drum was incorporated in a xerographic imaging machine fabricated by Xerox Corporation, Webster, NY; and available as the 5400® model. Images of excellent resolution, no blurring, were obtained for up to 1,000 imaging cycles, at which time the test was discontinued.

EXAMPLE VI

An amorphous silicon - silicon oxide photoreceptor is fabricated by essentially repeating the process of Example V with the exception that the order of deposition of the silicon oxide and the photoconductive silicon layer is interchanged. Thus, a xerographic imaging member is obtained which consists of, in addition to the aluminum substrate, a 1,000 Angstrom heavily doped amorphous silicon ground plane, a 0.5 micron layer of hydrogenated amorphous silicon photoconductive layer, a 10 micron layer of silicon oxide thereover, and an overcoating of silicon nitride. This device is incorporated into the xerographic printing machine known as the Xerox Corporation 5700® model, fabricated by Xerox Corporation, Webster, N.Y. Images of excellent resolution can be obtained for up to 10,000 cycles at a temperature of 19° C., and a relative humidity of 75 percent.

EXAMPLE VII

Photoreceptors of amorphous silicon - silicon oxide are fabricated by essentially repeating the process of Examples V and VI with the exception that a polymer substrate is clamped to the aluminum drum substrate. The resultant photoreceptor deposited on the flexible polymer substrate Kapton can generate excellent xerographic prints in a 1,000 imaging cycle test.

EXAMPLE VIII

Hydrogenated amorphous silicon photoreceptors are prepared by essentially repeating theprocess of Examples I, III and VI with the exception that the heavily boron-doped amorphous silicon ground plane (1,000 Angstroms thick) is replaced by a 1,000 Angstroms thick layer of heavily boron doped amorphous silicon carbide.

EXAMPLE IX

Hydrogenated amorphous silicon photoreceptors are prepared by essentially repeating the process of Examples II, IV and V with the exception that the heavily phorphorus-doped amorphous silicon ground plane (1,000 Angstroms thick) is replaced by a 1,000 Angstrms thick layer of heavily phosphorus doped amorphous silicon carbide.

Although the invention has been described with reference to specific preferred embodiments it is not intended to be limited thereto. Rather those skilled in the art will recognize variations, and modifications may be made therein which are within the spirit of the invention and within the scope of the following claims.

What is claimed is:

1. A photoresponsive imaging member comprised of a supporting insulating a substrate, ground plane of hydrogenated amorphous silicon having incorporated therein as dopants elements selected from Groups III and V of the periodic table; and in contact therewith a photoconductive layer of hydrogenated amorphous silicon.

2. A photoresponsive imaging member comprised of an insulating nonmetallic substrate, a ground plane of hydrogenated amorphous silicon having incorporated therein dopants; and a photoconductive layer comprised of hydrogenated amorphous silicon.

3. A photoresponsive imaging member comprised of a supporting insulating a substrate, ground plane of hydrogenated amorphous silicon having incorporated therein as dopants elements selected from the group consisting of phosphorus and boron; and in contact therewith a photoconductive layer of hydrogenated amorphous silicon.

4. A photoresponsive imaging member in accordance with claim 3 wherein the ground plane includes therein boron.

5. An imaging member in accordance with claim 3 wherein the ground plane includes therein phosphorus.

6. An imaging member in accordance with claim 3 wherein the phosphorus or boron are present in an amount of from about 1 part per million to 10,000 parts per million.

7. A photoresponsive imaging member in accordance with claim 3 wherein the amorphous silicon for the ground plane contains from about 10 to about 50 atomic percent hydrogen.

8. A photoresponsive imaging member in accordance with claim 3 wherein the amorphous silicon for the photoconductive layer contains from about 10 to about 50 atomic percent hydrogen.

9. An imaging member in accordance with claim 3 further including an overcoating layer.

10. An imaging member in accordance with claim 9 wherein the overcoating is selected from the group consisting of silicon carbide, amorphous carbon, and silicon nitride.

11. An imaging member comprised of a supporting insulating substrate, a ground plane of hydrogenated amorphous silicon with from about 10 to about 50 atomic percent of hydrogen having incorporated therein dopants; and a photoconductive layer of hyrogenated amorphous silicon.

12. An imaging member in accordnce with claim 11 wherein the dopants are selected from the group consisting of phosphorous and boron.

13. An imaging member in accordance with claim 11 wherein the phosphorous or boron are present in an amount of about 10,000 parts per million.

14. An imaging member in accordance with claim 11 wherein hydrogen is present in an amount of from about 10 to about 50 atomic percent, and the substrate is comprised of an insulating polymer composition.

15. An imaging member in accordance with claim 11 wherein there is further included an overcoating layer.

16. An imaging member in accordance with claim 15 wherein the overcoating is selected from the group consisting of silicon carbide, silicon nitride, and amorphous carbon.

17. A photoresponsive imaging member comprised of a supporting insulating a substrate ground plane containing hydrogenated amorphous silicon having incorporated therein dopants; a hydrogenated amorphous silicon photoconductive layer; and in contact therewith a charge transporting layer of plasma deposited silicon oxide containing at least 50 atomic percent of oxygen.

18. An imaging member in accordance with claim 17 wherein the silicon oxide charge transport layer is situated between the supporting substrate and the amorphous silicon layer.

19. An imaging member in accordance with claim 17 wherein the amorphous silicon photoconductive layer is situated between the supporting substrate and the silicon oxide charge transport layer.

20. An imaging member in accordance with claim 17 further including a protective top overcoating layer.

21. An imaging member in accordance with claim 19 wherein the amorphous silicon photoconductive layer is overcoated by a transparent and partially conductive passivation layer.

22. An imaging member in accordance with claim 17 wherein the photoconductive layer is comprised of amorphous silicon doped with phosphorus or boron separately or simultaneously in an amount of from about 1 part per million to about 100 parts per million.

23. An imaging member in accordance with claim 17 wherein the photoconductive layer is comprised of an amorphous silicon-germanium alloy.

24. An imaging member in accordance with claim 17 wherein the photoconductive layer is comprised of an amorphous silicon-tin alloy.

25. An imaging member in accordance with claim 17 wherein the photoconductive layer is comprised of an amorphous carbon-germanium alloy.

26. An imaging member in accordance with claim 17 wherein the transport layer of silicon oxide is prepared by the glow discharge of a mixture of a silane gas and a gaseous nitrogen oxygen compound.

27. An imaging member in accordance with claim 17 wherein the transport layer of silicon oxide is prepared by the glow discharge of a mixture of a silane gas, a gaseous nitrogen oxygen compound and a boron containing gas.

28. An imaging member in accordance with claim 17 wherein the transport layer of silicon oxide is prepared by the glow discharge of a mixture of a silane gas, a gaseous nitrogen oxygen compound and a phosphorus containing gas.

29. An imaging member in accordance with claim 18 wherein the thickness of the silicon oxide charge transport layer is from about 1.0 microns to about 10 microns.

30. An imaging member in accordance with claim 20 wherein the thickness of the overcoating layer is from about 0.1 micron to about 1.0 micron.

31. An imaging member in accordance with claim 20 wherein the overcoating layer results from plasma deposited silicon nitride, silicon oxynitride, silicon oxide, silicon carbide, amorphous carbon, or alumium oxide.

32. An imaging member in accordance with claim 17 wherein the ground plane dopants are selected from the group consisting of elements of Group III and Group V of the periodic table.

33. An imaging member in accordance with claim 32 wherein the dopants are selected from the ground consisting of phosphorus and boron.

34. An imaging member in accordance with claim 33 wherein the phosphorus or boron are present in an amount of about 10,000 parts per million.

35. A method of imaging which comprises providing the photoresponsive device of claim 1, subjecting the device to imagewise exposure, developing the resulting image with toner particles, subsequently transferring the image to a suitable substrate, and optionally permanently affixing the image thereto.

36. A method of imaging which comprises providing the photoresponsive device of claim 2 subjecting the device to imagewise exposure, developing the resulting image with toner particles, subsequently transferring the image to a suitable substrate, and optionally permanently affixing the image thereto.

37. A method of imaging which comprises providing the photoresponsive device of claim 3 subjecting the device to imagewise exposure, developing the resulting image with toner particles, subsequently transferring the image to a suitable substrate, and optionally permanently affixing the image thereto.

38. A method of imaging which comprises providing the photoresponsive device of claim 17 subjecting the device to imagewise exposure, developing the resulting image with toner particles, subsequently transferring the image to a suitable substrate, and optionally permanently affixing the image thereto.

39. A method of imaging in accordance with claim 35 wherein the ground plane of hydrogenated amorphous silicon has incorporated therein as dopants elements selected from the group consisting of phosphorous and boron.

40. A method of imaging in accordance with claim 36 wherein the ground plane of hydrogenated amorphous silicon has incorporated therein as dopants elements selected from the group consisting of phosphorous and boron.

41. A method of imaging in accordance with claim 37 wherein the ground plane of hydrogenated amorphous silicon has incorporated therein as dopants elements selected from the group consisting of phosphorous and boron.

42. A photoresponsive imaging member comprised of a supporting insulating substrate selected from the group consisting of insulating inorganic components, insulating organic components, and conductive components, a ground plane of hydrogenated amorphous silicon having incorporated therein as dopants, elements selected from Group III and V of the periodic table; and in contact therewith a photoconductive layer of hydrogenated amorphous silicon.

43. An imaging member in accordance with claim 42 wherein the supporting substrate is comprised of a polymer selected from the group consisting of polyimides and polycarbonates.

44. An imaging member in accordance with claim 42 wherein the supporting substrate is selected from the groups consisting of aluminum, chromium, nickel, brass, stainless steel, and ceramics.

45. A method of imaging in accordance with claim 38 wherein the ground plane of hydrogenated amorphous silicon has incorporated therein as dopants elements selected from the group consisting of phosphorous and boron.

46. A photoresponsive imaging member consisting essentially of a supporting substrate, a ground plane of hydrogenated amorphous silicon having incorporated therein as dopants elements selected from Groups III and V of the periodic table; and in contact therewith a photoconductive layer of hydrogenated amorphous silicon.

* * * * *